US008337071B2

(12) United States Patent
Negley et al.

(10) Patent No.: US 8,337,071 B2
(45) Date of Patent: Dec. 25, 2012

(54) LIGHTING DEVICE

(75) Inventors: Gerald H. Negley, Durham, NC (US); Antony Paul Van De Ven, Hong Kong (HK); F. Neal Hunter, Durham, NC (US)

(73) Assignee: Cree, Inc., Durham, NC (US)

( * ) Notice: Subject to any disclaimer, the term of this patent is extended or adjusted under 35 U.S.C. 154(b) by 0 days.

(21) Appl. No.: 11/613,692

(22) Filed: Dec. 20, 2006

(65) Prior Publication Data

US 2007/0139923 A1 Jun. 21, 2007

Related U.S. Application Data

(60) Provisional application No. 60/752,753, filed on Dec. 21, 2005.

(51) Int. Cl.
*H01R 33/00* (2006.01)

(52) U.S. Cl. ..... 362/648; 362/659; 362/658

(58) Field of Classification Search ..... 362/648, 362/659, 658, 253, 240, 640, 362
See application file for complete search history.

(56) References Cited

U.S. PATENT DOCUMENTS

| | | | | |
|---|---|---|---|---|
| 2,295,339 | A | 9/1942 | Ericson | |
| 2,907,870 | A | 10/1959 | Calmes | |
| 3,805,937 | A * | 4/1974 | Hatanaka et al. | 221/2 |
| 3,875,456 | A | 4/1975 | Kano et al. | |
| 3,927,290 | A | 12/1975 | Denley | |
| 4,120,026 | A | 10/1978 | Tsuchihashi et al. | |
| 4,325,146 | A * | 4/1982 | Lennington | 398/108 |
| 4,408,157 | A * | 10/1983 | Beaubien | 324/712 |
| 4,420,398 | A * | 12/1983 | Castino | 210/641 |
| 4,654,765 | A | 3/1987 | Laidman | |
| 4,710,699 | A | 12/1987 | Miyamoto | |
| 4,733,335 | A | 3/1988 | Serizawa et al. | |
| 4,918,497 | A | 4/1990 | Edmond | |
| 4,935,665 | A | 6/1990 | Murata | |
| 4,946,547 | A | 8/1990 | Palmour et al. | |

(Continued)

FOREIGN PATENT DOCUMENTS

DE 3916875 12/1990

(Continued)

OTHER PUBLICATIONS

Narendran et al., "Solid-state lighting: failure analysis of white LEDs", Journal of Crystal Growth, vol. 268, Issues 3-4, Aug. 1, 2004, Abstract.

(Continued)

*Primary Examiner* — Evan Dzierzynski
(74) *Attorney, Agent, or Firm* — Burr & Brown

(57) ABSTRACT

A lighting device comprises, or consists essentially of, a housing, a solid state light emitter and conductive tracks. The conductive tracks are positioned on the housing and are coupleable with a power supply. The conductive tracks comprise a positive conductive track and a negative conductive track. Each of the solid state light emitters is in electrical contact with a positive conductive track and a negative conductive track. Another lighting device comprises a fixture and a solid state light emitter in which the fixture comprises conductive elements which are coupleable to at least one power supply and the solid state light emitter is mounted on the fixture. There is also provided a lighting device which provides light of an intensity which is at least 50 percent of its initial intensity after 50,000 hours of illumination.

49 Claims, 6 Drawing Sheets

U.S. PATENT DOCUMENTS

| | | | | |
|---|---|---|---|---|
| 4,966,862 | A | 10/1990 | Edmond | |
| 5,027,168 | A | 6/1991 | Edmond | |
| 5,087,883 | A * | 2/1992 | Hoffman | 324/443 |
| 5,111,606 | A | 5/1992 | Reynolds | |
| 5,200,022 | A | 4/1993 | Kong et al. | |
| 5,210,051 | A | 5/1993 | Carter, Jr. | |
| 5,264,997 | A | 11/1993 | Hutchisson et al. | |
| 5,277,840 | A | 1/1994 | Osaka et al. | |
| 5,338,944 | A | 8/1994 | Edmond et al. | |
| RE34,861 | E | 2/1995 | Davis et al. | |
| 5,393,993 | A | 2/1995 | Edmond et al. | |
| 5,407,799 | A * | 4/1995 | Studier | 435/6 |
| 5,410,519 | A * | 4/1995 | Hall et al. | 367/127 |
| 5,416,342 | A | 5/1995 | Edmond et al. | |
| 5,477,436 | A | 12/1995 | Bertling et al. | |
| 5,523,589 | A | 6/1996 | Edmond et al. | |
| 5,563,849 | A * | 10/1996 | Hall et al. | 367/127 |
| 5,604,135 | A | 2/1997 | Edmond et al. | |
| 5,614,131 | A | 3/1997 | Mukerji et al. | |
| 5,631,190 | A | 5/1997 | Negley | |
| 5,739,554 | A | 4/1998 | Edmond et al. | |
| 5,766,987 | A | 6/1998 | Mitchell et al. | |
| 5,803,579 | A | 9/1998 | Turnbull et al. | |
| 5,813,753 | A | 9/1998 | Vriens | |
| 5,820,253 | A | 10/1998 | Scholz | |
| 5,851,063 | A | 12/1998 | Doughty et al. | |
| 5,858,278 | A | 1/1999 | Itoh et al. | |
| 5,890,794 | A | 4/1999 | Abtahi et al. | |
| 5,912,477 | A | 6/1999 | Negley | |
| 5,923,053 | A | 7/1999 | Jakowetz et al. | |
| 5,924,785 | A | 7/1999 | Zhang et al. | |
| 5,959,316 | A | 9/1999 | Lowery | |
| 5,962,971 | A | 10/1999 | Chen | |
| 5,998,925 | A | 12/1999 | Shimizu | |
| 6,001,671 | A | 12/1999 | Fjelstad | |
| 6,066,861 | A | 5/2000 | Hohn et al. | |
| 6,069,440 | A | 5/2000 | Shimizu et al. | |
| 6,076,936 | A | 6/2000 | George | |
| 6,082,870 | A | 7/2000 | George | |
| 6,084,250 | A | 7/2000 | Justel et al. | |
| 6,087,202 | A | 7/2000 | Exposito et al. | |
| 6,095,666 | A | 8/2000 | Salam | |
| 6,120,600 | A | 9/2000 | Edmond et al. | |
| 6,132,072 | A | 10/2000 | Turnbull et al. | |
| 6,139,304 | A | 10/2000 | Centofante | |
| 6,153,448 | A | 11/2000 | Takahashi | |
| 6,163,038 | A | 12/2000 | Chen et al. | |
| 6,187,606 | B1 | 2/2001 | Edmond et al. | |
| 6,201,262 | B1 | 3/2001 | Edmond et al. | |
| 6,212,213 | B1 | 4/2001 | Weber et al. | |
| 6,234,648 | B1 | 5/2001 | Borner et al. | |
| 6,244,728 | B1 | 6/2001 | Cote et al. | |
| 6,245,259 | B1 | 6/2001 | Hohn et al. | |
| 6,252,254 | B1 | 6/2001 | Soules et al. | |
| 6,255,670 | B1 | 7/2001 | Srivastava et al. | |
| 6,278,135 | B1 | 8/2001 | Srivastava et al. | |
| 6,278,607 | B1 | 8/2001 | Moore et al. | |
| 6,292,901 | B1 | 9/2001 | Lys et al. | |
| 6,294,800 | B1 | 9/2001 | Duggal et al. | |
| 6,319,425 | B1 | 11/2001 | Tasaki et al. | |
| 6,329,224 | B1 | 12/2001 | Nguyen et al. | |
| 6,331,063 | B1 | 12/2001 | Kamada et al. | |
| 6,335,538 | B1 | 1/2002 | Prutchi et al. | |
| 6,337,536 | B1 | 1/2002 | Matsubara et al. | |
| 6,338,813 | B1 | 1/2002 | Hsu et al. | |
| 6,348,766 | B1 * | 2/2002 | Ohishi et al. | 315/200 A |
| 6,350,041 | B1 | 2/2002 | Tarsa et al. | |
| 6,357,889 | B1 | 3/2002 | Duggal et al. | |
| 6,376,277 | B2 | 4/2002 | Corises | |
| 6,394,621 | B1 * | 5/2002 | Hanewinkel, III | 362/200 |
| 6,394,626 | B1 * | 5/2002 | McColloch | 362/231 |
| 6,396,081 | B1 | 5/2002 | Tews et al. | |
| 6,404,125 | B1 | 6/2002 | Garbuzov et al. | |
| 6,416,200 | B1 | 7/2002 | George | |
| 6,429,583 | B1 | 8/2002 | Levinson et al. | |
| 6,441,558 | B1 | 8/2002 | Muthu | |
| 6,441,943 | B1 | 8/2002 | Roberts et al. | |
| 6,469,322 | B1 | 10/2002 | Srivastava et al. | |
| 6,480,299 | B1 | 11/2002 | Drakopoulos et al. | |
| 6,482,520 | B1 | 11/2002 | Tzeng | |
| 6,501,100 | B1 | 12/2002 | Srivastava et al. | |
| 6,501,102 | B2 | 12/2002 | Mueller-Mach et al. | |
| 6,504,179 | B1 | 1/2003 | Ellens et al. | |
| 6,504,301 | B1 | 1/2003 | Lowery | |
| 6,509,651 | B1 | 1/2003 | Matsubara et al. | |
| 6,513,949 | B1 | 2/2003 | Marshall et al. | |
| 6,522,065 | B1 | 2/2003 | Srivastava et al. | |
| 6,531,328 | B1 | 3/2003 | Chen | |
| 6,538,371 | B1 | 3/2003 | Duggal et al. | |
| 6,550,949 | B1 | 4/2003 | Bauer et al. | |
| 6,552,495 | B1 | 4/2003 | Chang | |
| 6,576,930 | B2 | 6/2003 | Reech et al. | |
| 6,577,073 | B2 | 6/2003 | Shimizu et al. | |
| 6,578,986 | B2 | 6/2003 | Swaris et al. | |
| 6,578,998 | B2 | 6/2003 | Zhang | |
| 6,583,444 | B2 | 6/2003 | Fjelstad | |
| 6,592,810 | B2 | 7/2003 | Nishida et al. | |
| 6,600,175 | B1 | 7/2003 | Baretz et al. | |
| 6,600,324 | B2 | 7/2003 | St-Germain | |
| 6,603,258 | B1 | 8/2003 | Mueller-Mach et al. | |
| 6,608,332 | B2 | 8/2003 | Shimizu et al. | |
| 6,608,485 | B2 | 8/2003 | St-Germain | |
| 6,614,179 | B1 | 9/2003 | Shimizu et al. | |
| 6,616,862 | B2 | 9/2003 | Srivastava et al. | |
| 6,624,058 | B1 | 9/2003 | Kazama | |
| 6,624,350 | B2 | 9/2003 | Nixon et al. | |
| 6,636,003 | B2 | 10/2003 | Rahm et al. | |
| 6,642,652 | B2 | 11/2003 | Collins, III et al. | |
| 6,642,666 | B1 | 11/2003 | St-Germain | |
| 6,653,765 | B1 | 11/2003 | Levinson | |
| 6,659,632 | B2 | 12/2003 | Chen | |
| 6,685,852 | B2 | 2/2004 | Setlur et al. | |
| 6,686,691 | B1 | 2/2004 | Mueller et al. | |
| 6,692,136 | B2 | 2/2004 | Marshall et al. | |
| 6,703,173 | B2 | 3/2004 | Lu et al. | |
| 6,712,486 | B1 | 3/2004 | Popovich et al. | |
| 6,733,711 | B2 | 5/2004 | Durocher et al. | |
| 6,737,801 | B2 | 5/2004 | Ragle | |
| 6,740,972 | B2 | 5/2004 | Smith et al. | |
| 6,744,194 | B2 | 6/2004 | Fukasawa et al. | |
| 6,759,266 | B1 | 7/2004 | Hoffman | |
| 6,762,563 | B2 | 7/2004 | St-Germain | |
| 6,784,463 | B2 | 8/2004 | Camras et al. | |
| 6,791,119 | B2 | 9/2004 | Slater, Jr. et al. | |
| 6,791,257 | B1 * | 9/2004 | Sato et al. | 313/498 |
| 6,793,371 | B2 | 9/2004 | Lamke et al. | |
| 6,800,932 | B2 | 10/2004 | Lam et al. | |
| 6,805,474 | B2 | 10/2004 | Walser et al. | |
| 6,812,500 | B2 | 11/2004 | Reeh et al. | |
| 6,817,735 | B2 | 11/2004 | Shimizu et al. | |
| 6,841,804 | B1 | 1/2005 | Chen et al. | |
| 6,846,093 | B2 | 1/2005 | Swaris et al. | |
| 6,851,834 | B2 | 2/2005 | Leysath | |
| 6,853,010 | B2 | 2/2005 | Slater, Jr. et al. | |
| 6,857,767 | B2 | 2/2005 | Matsui et al. | |
| 6,860,621 | B2 | 3/2005 | Bachl et al. | |
| 6,864,573 | B2 | 3/2005 | Robertson et al. | |
| 6,871,982 | B2 | 3/2005 | Holman et al. | |
| 6,880,954 | B2 * | 4/2005 | Ollett et al. | 362/245 |
| 6,882,101 | B2 | 4/2005 | Ragle | |
| 6,914,267 | B2 | 7/2005 | Fukasawa et al. | |
| 6,919,683 | B1 | 7/2005 | Jang | |
| 6,936,857 | B2 | 8/2005 | Doxsee et al. | |
| 6,949,772 | B2 | 9/2005 | Shimizu et al. | |
| 6,958,497 | B2 | 10/2005 | Emerson et al. | |
| 6,967,116 | B2 | 11/2005 | Negley | |
| 7,001,047 | B2 | 2/2006 | Holder et al. | |
| 7,005,679 | B2 | 2/2006 | Tarsa et al. | |
| 7,008,078 | B2 | 3/2006 | Shimizu et al. | |
| 7,009,343 | B2 | 3/2006 | Lim et al. | |
| 7,014,336 | B1 | 3/2006 | Ducharme et al. | |
| 7,023,019 | B2 | 4/2006 | Maeda et al. | |
| 7,029,935 | B2 | 4/2006 | Negley et al. | |
| 7,030,486 | B1 | 4/2006 | Marshall | |
| 7,049,159 | B2 | 5/2006 | Lowery | |
| 7,061,454 | B2 | 6/2006 | Sasuga et al. | |
| 7,066,623 | B2 | 6/2006 | Lee et al. | |

7,083,302 B2 8/2006 Chen et al.
7,093,958 B2 8/2006 Coushaine
7,095,056 B2 8/2006 Vitta
7,095,110 B2 8/2006 Arik et al.
7,102,172 B2 9/2006 Lynch et al.
7,108,396 B2 9/2006 Swaris et al.
7,114,831 B2 10/2006 Popovich et al.
7,121,688 B2 10/2006 Rempel
7,125,143 B2 10/2006 Hacker
7,131,760 B2 11/2006 Mayer et al.
7,135,664 B2 11/2006 Vornsand et al.
7,144,140 B2 12/2006 Sun et al.
7,164,231 B2 1/2007 Choi et al.
7,178,941 B2 2/2007 Roberge et al.
7,183,587 B2 2/2007 Negley et al.
7,202,598 B2 4/2007 Juestel et al.
7,207,691 B2 4/2007 Lee et al.
7,210,832 B2 5/2007 Huang
7,213,940 B1 5/2007 Van De Ven et al.
7,215,074 B2 5/2007 Shimizu et al.
7,226,189 B2 6/2007 Lee et al.
7,232,212 B2 6/2007 Iwase
7,234,844 B2 6/2007 Bolta et al.
7,239,085 B2 7/2007 Kawamura
7,244,058 B2 7/2007 DiPenti et al.
7,246,921 B2 7/2007 Jacobson et al.
7,250,715 B2 7/2007 Meuller et al.
7,255,457 B2 8/2007 Ducharme et al.
7,256,557 B2 8/2007 Lim et al.
7,258,475 B2 8/2007 Kurumatani
7,276,861 B1 10/2007 Shteynberg et al.
7,286,296 B2 10/2007 Chaves et al.
7,306,353 B2 12/2007 Popovich et al.
7,329,024 B2 2/2008 Lynch et al.
7,350,955 B2 4/2008 Chang et al.
7,354,180 B2 4/2008 Sawhney et al.
7,355,284 B2 4/2008 Negley
7,358,954 B2 4/2008 Negley
7,365,485 B2 4/2008 Fukasawa et al.
7,374,311 B2 5/2008 Rains, Jr. et al.
7,387,405 B2 6/2008 Ducharme et al.
7,387,406 B2 6/2008 Swaris et al.
7,422,504 B2 9/2008 Maeda et al.
7,453,195 B2 11/2008 Radkov
7,474,044 B2 1/2009 Ge
2001/0002049 A1 5/2001 Reeh et al.
2001/0007526 A1* 7/2001 Ohkohdo et al. ..... 362/249
2002/0001869 A1 1/2002 Fjelstad
2002/0006040 A1 1/2002 Kamada et al.
2002/0006350 A1* 1/2002 Nishida et al. ..... 420/94
2002/0070449 A1 6/2002 Yagi et al.
2002/0070681 A1 6/2002 Shimizu et al.
2002/0087532 A1* 7/2002 Barritz et al. ..... 707/3
2002/0096789 A1 7/2002 Bolken
2002/0105266 A1 8/2002 Juestel et al.
2002/0123164 A1 9/2002 Slater, Jr. et al.
2002/0185965 A1 12/2002 Collins, III et al.
2003/0006418 A1 1/2003 Emerson et al.
2003/0026096 A1 2/2003 Ellens et al.
2003/0030063 A1 2/2003 Sosniak et al.
2003/0034985 A1 2/2003 Needham Riddle et al.
2003/0038596 A1 2/2003 Ho
2003/0066311 A1 4/2003 Li et al.
2003/0067773 A1 4/2003 Marshall et al.
2003/0117798 A1 6/2003 Leysath
2003/0121511 A1 7/2003 Hashimura et al.
2003/0146411 A1 8/2003 Srivastava et al.
2003/0207500 A1 11/2003 Pichler et al.
2003/0222268 A1 12/2003 Yocom et al.
2004/0004435 A1 1/2004 Hsu
2004/0012958 A1 1/2004 Hashimoto et al.
2004/0037949 A1 2/2004 Wright
2004/0038442 A1 2/2004 Kinsman
2004/0041222 A1 3/2004 Loh et al.
2004/0046178 A1 3/2004 Sano
2004/0051111 A1 3/2004 Ota et al.
2004/0056260 A1 3/2004 Slater, Jr. et al.
2004/0090174 A1 5/2004 Tasch et al.
2004/0090794 A1* 5/2004 Ollett et al. ..... 362/555
2004/0096666 A1 5/2004 Knox et al.
2004/0105264 A1 6/2004 Spero
2004/0106234 A1 6/2004 Sorg et al.
2004/0165379 A1 8/2004 Waters
2004/0212998 A1 10/2004 Mohacsi
2004/0218387 A1 11/2004 Gerlach
2004/0223328 A1* 11/2004 Lee et al. ..... 362/249
2004/0252962 A1* 12/2004 Ryan, Jr. ..... 385/147
2004/0264193 A1 12/2004 Okumura
2005/0001537 A1 1/2005 West et al.
2005/0002168 A1 1/2005 Narhi et al.
2005/0051789 A1 3/2005 Negley et al.
2005/0052378 A1 3/2005 Hacker
2005/0058947 A1 3/2005 Rinehart et al.
2005/0058948 A1 3/2005 Freese et al.
2005/0058949 A1 3/2005 Wood et al.
2005/0077525 A1 4/2005 Lynch et al.
2005/0092517 A1 5/2005 Fan
2005/0094105 A1 5/2005 Otsuka et al.
2005/0099478 A1 5/2005 Iwase
2005/0128751 A1 6/2005 Robarge et al.
2005/0135441 A1 6/2005 Ng et al.
2005/0161586 A1 7/2005 Rains, Jr. et al.
2005/0168689 A1 8/2005 Knox
2005/0174780 A1 8/2005 Park
2005/0231948 A1* 10/2005 Pohlert et al. ..... 362/237
2005/0237739 A1* 10/2005 Lee et al. ..... 362/241
2005/0243556 A1 11/2005 Lynch
2005/0251698 A1 11/2005 Lynch et al.
2005/0259423 A1 11/2005 Heuser
2005/0265404 A1 12/2005 Ashdown
2005/0274972 A1 12/2005 Roth et al.
2005/0278998 A1 12/2005 Sawhney et al.
2005/0280756 A1 12/2005 Kim et al.
2006/0001046 A1 1/2006 Batres et al.
2006/0012989 A1 1/2006 Lee
2006/0022582 A1 2/2006 Radkov
2006/0060872 A1 3/2006 Edmond et al.
2006/0061539 A1 3/2006 Song et al.
2006/0061869 A1 3/2006 Fadel et al.
2006/0067073 A1 3/2006 Ting
2006/0081773 A1 4/2006 Rains, Jr. et al.
2006/0098440 A1 5/2006 Allen
2006/0105482 A1 5/2006 Alferink et al.
2006/0113548 A1 6/2006 Chen et al.
2006/0114422 A1 6/2006 Miyazawa et al.
2006/0114569 A1 6/2006 Capaldo et al.
2006/0114673 A1 6/2006 Cunnien
2006/0120073 A1* 6/2006 Pickard et al. ..... 362/217
2006/0138435 A1 6/2006 Tarsa et al.
2006/0138937 A1 6/2006 Ibbetson
2006/0152140 A1 7/2006 Brandes
2006/0157721 A1 7/2006 Tran et al.
2006/0158080 A1 7/2006 Nakano et al.
2006/0164729 A1 7/2006 Wood
2006/0180818 A1 8/2006 Nagai
2006/0181192 A1 8/2006 Radkov
2006/0187660 A1 8/2006 Liu
2006/0245184 A1 11/2006 Galli
2006/0267028 A1 11/2006 Lynch et al.
2006/0275714 A1 12/2006 Rinehart et al.
2006/0285332 A1 12/2006 Goon et al.
2007/0001188 A1 1/2007 Lee
2007/0003868 A1 1/2007 Wood et al.
2007/0008738 A1 1/2007 Han et al.
2007/0014004 A1 1/2007 Wood
2007/0041220 A1 2/2007 Lynch
2007/0047204 A1 3/2007 Parker et al.
2007/0051966 A1 3/2007 Higashi
2007/0064450 A1 3/2007 Chiba et al.
2007/0090381 A1 4/2007 Otsuka et al.
2007/0096131 A1 5/2007 Chandra
2007/0127098 A1 6/2007 Wood
2007/0127129 A1 6/2007 Wood et al.
2007/0137074 A1 6/2007 Van De Ven et al.
2007/0139920 A1 6/2007 Van De Ven et al.
2007/0139923 A1 6/2007 Negley et al.
2007/0170447 A1 7/2007 Negley
2007/0171145 A1 7/2007 Coleman et al.

| | | | |
|---|---|---|---|
| 2007/0188425 | A1 | 8/2007 | Saccomanno |
| 2007/0202623 | A1 | 8/2007 | Gao |
| 2007/0216704 | A1 | 9/2007 | Roberts et al. |
| 2007/0223219 | A1 | 9/2007 | Medendorp et al. |
| 2007/0236911 | A1 | 10/2007 | Negley |
| 2007/0242441 | A1 | 10/2007 | Aldrich et al. |
| 2007/0247414 | A1 | 10/2007 | Roberts |
| 2007/0247847 | A1 | 10/2007 | Villard |
| 2007/0262337 | A1 | 11/2007 | Villard |
| 2007/0263393 | A1 | 11/2007 | Van De Ven et al. |
| 2007/0267983 | A1 | 11/2007 | Van De Ven et al. |
| 2007/0274063 | A1 | 11/2007 | Negley |
| 2007/0274080 | A1 | 11/2007 | Negley et al. |
| 2007/0276606 | A1 | 11/2007 | Radkov |
| 2007/0278503 | A1 | 12/2007 | Van De Ven et al. |
| 2007/0278934 | A1 | 12/2007 | Van De Ven et al. |
| 2007/0278974 | A1 | 12/2007 | Van De Ven |
| 2007/0279440 | A1 | 12/2007 | Negley |
| 2007/0279903 | A1 | 12/2007 | Negley |
| 2007/0280624 | A1 | 12/2007 | Negley et al. |
| 2008/0006815 | A1 | 1/2008 | Wang et al. |
| 2008/0055915 | A1 | 3/2008 | Lynch et al. |
| 2008/0062699 | A1 | 3/2008 | Popovich et al. |
| 2008/0084685 | A1 | 4/2008 | Van De Ven |
| 2008/0084700 | A1 | 4/2008 | Van De Ven |
| 2008/0084701 | A1 | 4/2008 | Van De Ven et al. |
| 2008/0088248 | A1 | 4/2008 | Myers |
| 2008/0089053 | A1 | 4/2008 | Negley |
| 2008/0103714 | A1 | 5/2008 | Aldrich et al. |
| 2008/0106895 | A1 | 5/2008 | Van De Ven |
| 2008/0106907 | A1 | 5/2008 | Trott et al. |
| 2008/0112168 | A1 | 5/2008 | Pickard et al. |
| 2008/0112170 | A1 | 5/2008 | Trott et al. |
| 2008/0112183 | A1 | 5/2008 | Negley |
| 2008/0130265 | A1 | 6/2008 | Negley |
| 2008/0130285 | A1 | 6/2008 | Negley |
| 2008/0136313 | A1 | 6/2008 | Van De Ven et al. |
| 2008/0137347 | A1 | 6/2008 | Trott et al. |
| 2008/0170396 | A1 | 7/2008 | Yuan et al. |
| 2008/0179602 | A1 | 7/2008 | Negley |
| 2008/0192462 | A1 | 8/2008 | Steedly et al. |
| 2008/0192493 | A1 | 8/2008 | Villard |
| 2008/0211416 | A1 | 9/2008 | Negley et al. |
| 2008/0231201 | A1 | 9/2008 | Higley et al. |
| 2008/0259589 | A1 | 10/2008 | Van De Ven et al. |
| 2008/0278928 | A1 | 11/2008 | Van De Ven et al. |
| 2008/0278940 | A1 | 11/2008 | Van De Ven et al. |
| 2008/0278950 | A1 | 11/2008 | Pickard et al. |
| 2008/0278952 | A1 | 11/2008 | Trott et al. |
| 2008/0304260 | A1 | 12/2008 | Van De Ven et al. |
| 2008/0304261 | A1 | 12/2008 | Van De Ven et al. |
| 2008/0304269 | A1 | 12/2008 | Pickard et al. |
| 2008/0309255 | A1 | 12/2008 | Myers |
| 2008/0310154 | A1 | 12/2008 | Van De Ven et al. |
| 2009/0002986 | A1 | 1/2009 | Medendorp et al. |

FOREIGN PATENT DOCUMENTS

| | | |
|---|---|---|
| DE | 10-335077 | 3/2005 |
| EP | 0 242 901 | 10/1987 |
| EP | 0 838 866 | 4/1998 |
| EP | 0 971 421 | 1/2000 |
| EP | 1 024 399 | 8/2000 |
| EP | 1 059 678 | 12/2000 |
| EP | 1 081 771 | 3/2001 |
| EP | 1 111 966 | 6/2001 |
| EP | 1 138 747 | 10/2001 |
| EP | 1 160 883 | 12/2001 |
| EP | 1 193 772 | 4/2002 |
| EP | 1 198 016 | 4/2002 |
| EP | 1 367 655 | 12/2003 |
| EP | 1 385 215 | 1/2004 |
| EP | 1 462 711 | 12/2004 |
| EP | 1 486 818 | 12/2004 |
| EP | 1 553 431 | 7/2005 |
| EP | 1 566 848 | 8/2005 |
| EP | 1 571 715 | 9/2005 |
| EP | 1 760 795 | 1/2006 |
| EP | 1 724 848 | 11/2006 |
| FR | 2 704 690 | 11/1994 |
| JP | 05-100106 | 4/1993 |
| JP | 10-163535 | 6/1998 |
| JP | 11-040858 | 2/1999 |
| JP | 2000-002802 | 1/2000 |
| JP | 2000-022222 | 1/2000 |
| JP | 2000-183408 | 6/2000 |
| JP | 2000-208820 | 7/2000 |
| JP | 2001-111114 | 4/2001 |
| JP | 2001-156331 | 6/2001 |
| JP | 2001-181613 | 7/2001 |
| JP | 2001-307506 | 11/2001 |
| JP | 2002-009097 | 1/2002 |
| JP | 2002-150821 | 5/2002 |
| JP | 2003-515956 | 5/2003 |
| JP | 2004-080046 | 3/2004 |
| JP | 2004-103443 | 4/2004 |
| JP | 2004-221185 | 8/2004 |
| JP | 2004-253309 | 9/2004 |
| JP | 2004-356116 | 12/2004 |
| JP | 2004-363055 | 12/2004 |
| JP | 2005-005482 | 1/2005 |
| JP | 2005-101296 | 4/2005 |
| JP | 2005-142311 | 6/2005 |
| JP | 2005-298817 | 10/2005 |
| JP | 2006-054209 | 2/2006 |
| JP | 2007-122950 | 5/2007 |
| JP | 2007-141737 | 6/2007 |
| TW | 546854 | 8/2003 |
| WO | 98/43014 | 10/1998 |
| WO | 00/34709 | 6/2000 |
| WO | 01/24283 | 4/2001 |
| WO | 01/41215 | 6/2001 |
| WO | 01/69692 | 9/2001 |
| WO | 01/77578 | 10/2001 |
| WO | 02/097770 | 12/2002 |
| WO | 03/021691 | 3/2003 |
| WO | 2004/068909 | 8/2004 |
| WO | 2004/070768 | 8/2004 |
| WO | 2004/114736 | 12/2004 |
| WO | 2005/004202 | 1/2005 |
| WO | 2005/013365 | 10/2005 |
| WO | 2005/101909 | 10/2005 |
| WO | 2005/114753 | 12/2005 |
| WO | 2005/124877 | 12/2005 |
| WO | 2006/028312 | 3/2006 |
| WO | 2006/033695 | 3/2006 |
| WO | 2006/036251 | 4/2006 |
| WO | 2007/018560 | 2/2007 |
| WO | 2007/026776 | 3/2007 |
| WO | 2007/061758 | 5/2007 |

OTHER PUBLICATIONS

OptoLED Product Sheets, http://www.optoled.de/englisch/products/led.html, pp. 1-7, (date not known).

Permlight Product Sheet, http://www.permlightforsigns.com/, pp. 1, Feb. 2005.

U.S. Appl. No. 11/982,276, filed Oct. 31, 2007.

U.S. Appl. No. 11/673,951, filed Feb. 12, 2007.

U.S. Appl. No. 11/743,324, filed May 2, 2007.

U.S. Appl. No. 11/689,614, filed Mar. 22, 2007.

U.S. Appl. No. 12/046,549, filed Mar. 12, 2008.

U.S. Appl. No. 11/379,709, filed Apr. 21, 2006.

U.S. Appl. No. 11/408,767, filed Apr. 21, 2006.

U.S. Appl. No. 11/408,648, filed Apr. 21, 2006.

U.S. Appl. No. 12/146,018, filed Jun. 27, 2008.

Narendran et al., "Solid State lighting: failure analysis of white LEDs," Journal of Cystal Growth, vol. 268, Issues 1-4, Aug. 2004, Abstract.

Compound Semiconductors Online, "LED Lighting Fixtures, Inc. Sets World Record at 80 Lumens per Watt for Warm White", Compound Semiconductors Online, May 30, 2006, p. 1.

CSA International, "Test Data Report," Project No. 1786317, Report No. 1,786317-1 (Apr. 2006).

DOE SSL CALiPer Report, "Product Test Reference: CALiPER 07-31 Downlight Lamp", (Sep. 2007).

DOE SSL CALiPer Report, "Product Test Reference: CALiPER 07-47 Downlight Lamp" (Sep. 2007).

Press Release from LED Lighting Fixtures dated Apr. 24, 2006 entitled "LED Lighting Fixtures, Inc. achieves unprecedented gain in light output from new luminaire".
Press Release from LED Lighting Fixtures dated Feb. 16, 2006 entitled "LED Lighting Fixtures, Inc. Announces Record Performance".
Press Release from LED Lighting Fixtures dated Feb. 7, 2007 entitled "LED Lighting Fixtures Announces its first LED-based Recessed Down Light".
Press Release from LED Lighting Fixtures dated Jan. 26, 2006 entitled "LED Lighting Fixtures Creates 750 Lumen Recessed Light and Uses Only 16 Watts of Power".
Press Release from LED Lighting Fixtures dated May 30, 2006 entitled "LED Lighting Fixtures, Inc. Sets World Record at 80 Lumens per Watt for Warm White Fixture".
Press Release from LED Lighting Fixtures dated May 4, 2007 entitled "LED Lighting Fixtures to Expand Product Line".
Press Release from LED Lighting Fixtures dated Nov. 28, 2007 entitled "New Lamp from LED Lighting Fixtures Shatter World Record for Energy Efficiency".
Shimizu, "Development of High-Efficiency LED Downlight", First International Conference on White LEDs and Solid State Lighting, Nov. 30, 2007.
U.S. Department of Energy, "DOE Solid-State Lighting CALiPER Program, Summary of Results: Round 3 of Product Testing," Oct. 2007.
U.S. Department of Energy, "DOE Solid-State Lighting CALiPER Program, Summary of Results: Round 4 of Product Testing," Jan. 2008.
U.S. Department of Energy, "DOE Solid-State Lighting Caliper Program, Summary of Results: Round 5 of Product Testing," May 2008.
Van De Ven et al., "Warm White Illumination with High CRI and High Efficacy by Combining 455 nm Excited Yellowish Phosphor LEDs and Red A1InGaP LEDs," First International Conference on White LEDs and Solid State Lighting, Nov. 30, 2007.
Chhajed, S., *Influence of junction temperature on chromaticity and color-rendering properties of trichromatic white-light sources* . . . , Journal of Applied Physics, 2005, vol. 97 pp. 1-8.
Color Kinetics Inc., Color Kinetics Support : White Papers & Presentations; available at http://www.colorkinetics.com/support/whitepapers/:, Solid State Lighting White Papers & Presentations, Feb. 22, 2006, pp. 1-4.
Color Kinetics Inc., *Color Quality of Intelligent Solid-State Light Systems*, Color Quality of Solid-State Light Sources, Mar. 2005, pp. 1-3.
Cree, Inc., "Cree® Xlamp® 7090 XR-E Series LED Binning and Labeling," Application Note: CLD-AP08.000, 7pp (2006).
CSA International, "Test Data Report," Project No. 1786317, Report No. 1786317-1 (Apr. 2006).
DOE SSL CALiPer Report, "Product Test Reference: CALiPER 07-31 Downlight Lamp".
DOE SSL CALiPer Report, "Product Test Reference: CALiPER 07-47 Downlight Lamp".
Krames et al., *Lumileds Lighting, Light from Silicon Valley*, Progress and Future Direction of LED Technology, SSL Workshop, Nov. 13, 2003, Publisher: Limileds Lighting Inc., pp. 1-21.
Narendran et al., *Color Rendering Properties of LED Light Sources*, 2002, pp. 1-8.
Nichia, White Light LED, Part Nos. NSPW300BS and NSPW312BS, High Brightness LEDs, Nov. 12, 1999, Publisher: Nichia Corporation.
OptoLED Lighting Inc., *OptoLED Product Information*, 2009, Publisher: OptoLED GmBH website: accessed at http://222.optoled.de/englisch/products/led.html.
Permlight Inc., *Enbryten LED Product Information*, Feb. 2005, Publisher: Permlight Inc. website; accessed at http://www.webarchive.org displaying that www.permlight.com/products/LEDfixtures.asp was publicly available Jan. 2004.
Cree, Inc., "Cree® Xlamp® 7090 XR-E Series LED Data Sheet," Datasheet: CLD-DS05.000, 10 pp (2006).
Cree, Inc., "Cree® Xlamp® 7090 XR-E Series LED Secondary Optics," Datasheet: CLD-DS07.000, 3 pp (2004-2006).
McMaster-Carr Supply Company, "Multipurpose Aluminum (Alloy 6061), specification sheets," Retrieved Dec. 14, 2006 from www.mcmaster.com/param/asp/Psearch2.asp?regTyp=parametric &act=psearch%F... , 3 pp.
Burden, A.P., *Materials for Field Emission Displays*,International Materials Reviews, 2001.
Lau, John, *Flip-Chip Technologies*, McGraw Hill, 1996, pp.
NASA Tech Briefs Issue, *NPO-30394 Electrophoretic Deposition for Fabricating Microbatteries*, May 3, 2003, p. 1-2.
Nichia, White LED, Part Nos. NSPW300BS, "Specifications for Nichia White LED, Model NSPW300BS," Nichia Corporation, Jan. 12, 2004.
Nichia, White LED, Part Nos. NSPW312BS, "Specifications for Nichia White LED, Model NSPW312BS," Nichia Corporation, Jan. 14, 2004.
Cree LED Light, LR6, 6 Downlight Module, Product Description, 2 pp.

* cited by examiner

LIGHTING DEVICE

CROSS-REFERENCE TO RELATED APPLICATIONS

This application claims the benefit of U.S. Provisional Patent Application No. 60/752,753, filed Dec. 21, 2005, the entirety of which is incorporated herein by reference.

FIELD OF THE INVENTION

The present invention relates to a lighting device, in particular, a device which includes one or more solid state light emitters. The present invention also relates to a lighting device which includes one or more solid state light emitters, and which optionally further includes one or more luminescent materials (e.g., one or more phosphors). In a particular aspect, the present invention relates to a lighting device which includes one or more light emitting diodes, and optionally further includes one or more luminescent materials.

BACKGROUND OF THE INVENTION

A large proportion (some estimates are as high as one third) of the electricity generated in the United States each year goes to lighting. Accordingly, there is an ongoing need to provide lighting which is more energy-efficient. It is well-known that incandescent light bulbs are very energy-inefficient light sources—about ninety percent of the electricity they consume is released as heat rather than light. Fluorescent light bulbs are more efficient than incandescent light bulbs (by a factor of about 4) but are still quite inefficient as compared to solid state light emitters, such as light emitting diodes.

In addition, as compared to the normal lifetimes of solid state light emitters, incandescent light bulbs have relatively short lifetimes, i.e., typically about 750-1000 hours. In comparison, the lifetime of light emitting diodes, for example, can generally be measured in decades. Fluorescent bulbs have longer lifetimes (e.g., 10,000-20,000 hours) than incandescent lights, but provide less favorable color reproduction. Color reproduction is typically measured using the Color Rendering Index (CRI) which is a relative measure of the shift in surface color of an object when lit by a particular lamp. Daylight has the highest CRI (of 100), with incandescent bulbs being relatively close (about 95), and fluorescent lighting being less accurate (70-85). Certain types of specialized lighting have relatively low CRI's (e.g., mercury vapor or sodium, both as low as about 40 or even lower).

Another issue faced by conventional light fixtures is the need to periodically replace the lighting devices (e.g., light bulbs, etc.). Such issues are particularly pronounced where access is difficult (e.g., vaulted ceilings, bridges, high buildings, traffic tunnels) and/or where change-out costs are extremely high. The typical lifetime of conventional fixtures is about 20 years, corresponding to a light-producing device usage of at least about 44,000 hour's (based on usage of 6 hours per day for 20 years). Light-producing device lifetime is typically much shorter, thus creating the need for periodic change-outs.

Accordingly, for these and other reasons, efforts have been ongoing to develop ways by which solid state light emitters can be used in place of incandescent lights, fluorescent lights and other light-generating devices in a wide variety of applications. In addition, where light emitting diodes (or other solid state light emitters) are already being used, efforts are ongoing to provide light emitting diodes (or other solid state light emitters) which are improved, e.g., with respect to energy efficiency, color rendering index (CRI), efficacy (1 m/W), and/or duration of service.

A variety of solid state light emitters are well-known. For example, one type of solid state light emitter is a light emitting diode. Light emitting diodes are well-known semiconductor devices that convert electrical current into light. A wide variety of light emitting diodes are used in increasingly diverse fields for an ever-expanding range of purposes.

More specifically, light emitting diodes are semiconducting devices that emit light (ultraviolet, visible, or infrared) when a potential difference is applied across a p n junction structure. There are a number of well-known ways to make light emitting diodes and many associated structures, and the present invention can employ any such devices. By way of example, Chapters 12-14 of Sze, Physics of Semiconductor Devices, (2d Ed. 1981) and Chapter 7 of Sze, Modern Semiconductor Device Physics (1998) describe a variety of photonic devices, including light emitting diodes.

The expression "light emitting diode" is used herein to refer to the basic semiconductor diode structure (i.e., the chip). The commonly recognized and commercially available "LED" that is sold (for example) in electronics stores typically represents a "packaged" device made up of a number of parts. These packaged devices typically include a semiconductor based light emitting diode such as (but not limited to) those described in U.S. Pat. Nos. 4,918,487; 5,631,190; and 5,912,477; various wire connections, and a package that encapsulates the light emitting diode.

As is well-known, a light emitting diode produces light by exciting electrons across the band gap between a conduction band and a valence band of a semiconductor active (light-emitting) layer. The electron transition generates light at a wavelength that depends on the band gap. Thus, the color of the light (wavelength) emitted by a light emitting diode depends on the semiconductor materials of the active layers of the light emitting diode.

Although the development of light emitting diodes has in many ways revolutionized the lighting industry, some of the characteristics of light emitting diodes have presented challenges, some of which have not yet been fully met. For example, the emission spectrum of any particular light emitting diode is typically concentrated around a single wavelength (as dictated by the light emitting diode's composition and structure), which is desirable for some applications, but not desirable for others, (e.g., for providing lighting, such an emission spectrum provides a very low CRI).

Because light that is perceived as white is necessarily a blend of light of two or more colors (or wavelengths), no single light emitting diode can produce white light. "White" light emitting diodes have been produced which have a light emitting diode pixel formed of respective red, green and blue light emitting diodes. Other "white" light emitting diodes have been produced which include (1) a light emitting diode which generates blue light and (2) a luminescent material (e.g., a phosphor) that emits yellow light in response to excitation by light emitted by the light emitting diode, whereby the blue light and the yellow light, when mixed, produce light that is perceived as white light.

In addition, the blending of primary colors to produce combinations of non-primary colors is generally well understood in this and other arts. In general, the 1931 CIE Chromaticity Diagram (an international standard for primary colors established in 1931), and the 1976 CIE Chromaticity Diagram (similar to the 1931 Diagram but modified such that similar distances on the Diagram represent similar differences in color) provide useful reference for defining colors as weighted sums of primary colors.

Light emitting diodes can thus be used individually or in any combinations, optionally together with one or more luminescent material (e.g., phosphors or scintillators) and/or filters, to generate light of any desired perceived color (including white). Accordingly, the areas in which efforts are being made to replace existing light sources with light emitting diode light sources, e.g., to improve energy efficiency, color rendering index (CRI), efficacy (1 m/W), and/or duration of service, are not limited to any particular color or color blends of light.

A wide variety of luminescent materials (also known as lumiphors or liminophoric media, e.g., as disclosed in U.S. Pat. No. 6,600,175, the entirety of which is hereby incorporated by reference) are well-known and available to persons of skill in the art. For example, a phosphor is a luminescent material that emits a responsive radiation (e.g., visible light) when excited by a source of exciting radiation. In many instances, the responsive radiation has a wavelength which is different from the wavelength of the exciting radiation.

Other examples of luminescent materials include scintillators, day glow tapes and inks which glow in the visible spectrum upon illumination with ultraviolet light.

Luminescent materials can be categorized as being down-converting, i.e., a material which converts photons to a lower energy level (longer wavelength) or up-converting, i.e., a material which converts photons to a higher energy level (shorter wavelength).

Inclusion of luminescent materials in LED devices has been accomplished by adding the luminescent materials to a clear encapsulant material (e.g., epoxy-based or silicone-based material) as discussed above, for example by a blending or coating process.

For example, U.S. Pat. No. 6,963,166 (Yano '166) discloses that a conventional light emitting diode lamp includes a light emitting diode chip, a bullet-shaped transparent housing to cover the light emitting diode chip, leads to supply current to the light emitting diode chip, and a cup reflector for reflecting the emission of the light emitting diode chip in a uniform direction, in which the light emitting diode chip is encapsulated with a first resin portion, which is further encapsulated with a second resin portion. According to Yano '166, the first resin portion is obtained by filling the cup reflector with a resin material and curing it after the light emitting diode chip has been mounted onto the bottom of the cup reflector and then has had its cathode and anode electrodes electrically connected to the leads by way of wires. According to Yano '166, a phosphor is dispersed in the first resin portion so as to be excited with the light A that has been emitted from the light emitting diode chip, the excited phosphor produces fluorescence ("light B") that has a longer wavelength than the light A, a portion of the light A is transmitted through the first resin portion including the phosphor, and as a result, light C, as a mixture of the light A and light B, is used as illumination.

As noted above, "white LED lights" (i.e., lights which are perceived as being white or near-white) have been investigated as potential replacements for white incandescent lamps. A representative example of a white LED lamp includes a package of a blue light emitting diode chip, made of gallium nitride (GaN), coated with a phosphor such as YAG. In such an LED lamp, the blue light emitting diode chip produces an emission with a wavelength of about 450 nm, and the phosphor produces yellow fluorescence with a peak wavelength of about 550 nm on receiving that emission. For instance, in some designs, white light emitting diodes are fabricated by forming a ceramic phosphor layer on the output surface of a blue light-emitting semiconductor light emitting diode. Part of the blue ray emitted from the light emitting diode chip passes through the phosphor, while part of the blue ray emitted from the light emitting diode chip is absorbed by the phosphor, which becomes excited and emits a yellow ray. The part of the blue light emitted by the light emitting diode which is transmitted through the phosphor is mixed with the yellow light emitted by the phosphor. The viewer perceives the mixture of blue and yellow light as white light.

As also noted above, in another type of LED lamp, a light emitting diode chip that emits an ultraviolet ray is combined with phosphor materials that produce red (R), green (G) and blue (B) light rays. In such an LED lamp, the ultraviolet ray that has been radiated from the light emitting diode chip excites the phosphor, causing the phosphor to emit red, green and blue light rays which, when mixed, are perceived by the human eye as white light. Consequently, white light can also be obtained as a mixture of these light rays.

Designs have been provided in which existing LED component packages and other electronics are assembled into a fixture. In such designs, a packaged LED is mounted to a circuit board, the circuit board is mounted to a heat sink, and the heat sink is mounted to the fixture housing along with required drive electronics. In many cases, additional optics (secondary to the package parts) are also necessary.

In substituting light emitting diodes for other light sources, e.g., incandescent light bulbs, packaged LEDs have been used with conventional light fixtures, for example, fixtures which include a hollow lens and a base plate attached to the lens, the base plate having a conventional socket housing with one or more contacts which is electrically coupled to a power source. For example, LED light bulbs have been constructed which comprise an electrical circuit board, a plurality of packaged LEDs mounted to the circuit board, and a connection post attached to the circuit board and adapted to be connected to the socket housing of the light fixture, whereby the plurality of LEDs can be illuminated by the power source.

There is an ongoing need for ways to use solid state light emitters, e.g., light emitting diodes, in a wider variety of applications, with greater energy efficiency, with improved color rendering index (CRI), with improved contrast, with improved efficacy (1 m/W), and/or with longer duration of service, for all possible light colors, including white light (including light perceived as white light).

BRIEF SUMMARY OF THE INVENTION

In one aspect, the present invention is directed to a lighting device which employs solid state light emitters at the chip/dice level (light emitting diodes, laser diodes, thin film electroluminescent devices, etc) which are attached to the housing of the device, the housing of the device preferably providing both the thermal and optical solution for the device. Such a design eliminates thermal interfaces (to reduce the temperature of the light source (e.g., light emitting diodes)) and reduces cost as the light emitting diode(s) or light source(s) is/are built "bottoms up" within the system to minimize cost and maximize performance. In a preferred aspect, the entire integration involves: a) light emitting diode chips mounted directly to the fixture with the required optics integrated into the fixture and the required drive electronics, in which the fixture provides the function of thermal and optical solutions, thereby reducing the complexity of many subassemblies used in conventional designs.

In a specific aspect, the lighting device is one that can produce light that is perceived as "white".

According to a first embodiment, there is provided a lighting device comprising, or consisting essentially of, a housing, at least one solid state light emitter, and conductive tracks.

The conductive tracks are coupleable with at least one power supply. The conductive tracks are positioned on at least a first portion of the housing, and the conductive tracks comprise at least a first positive conductive track and at least a first negative conductive track. Each of the solid state light emitters is in electrical contact with at least one positive conductive track and at least one negative conductive track.

The expression "on", e.g., as used in the preceding paragraph in the expression "positioned on", or in the expressions "mounted on", "formed on", "painted on", "printed on", or "trace on a circuit board", means that the first structure which is "on" a second structure can be in contact with the second structure, or can be separated from the second structure by one or more intervening structures.

The expression "conductive track", as used herein, refers to a structure which comprises a conductive portion, and may further include any other structure, e.g., one or more insulating layers. For example, a conductive track mounted on a housing might consist of an insulating layer and a conductive layer, particularly where the housing is capable of conducting electricity (in which case the conductive track is mounted on the housing with the insulating layer of the conductive track in contact with the housing and the conductive layer of the conductive track not in contact with the housing, and one or more light emitting diode chips are electrically connected to the conductive layers of the conductive tracks such that the light emitting diode chips can be powered by electricity and illuminated.

In a particular aspect of the invention, the lighting device comprises a plurality of solid state light emitters. In a further particular aspect, the one or more solid state light emitters is/are light emitting diode(s).

In a further aspect of the invention, the lighting device further comprises at least a first luminescent material, e.g., a first phosphor.

In a second aspect, the present invention provides a lighting device comprising a fixture comprising conductive elements which are coupleable to at least one power supply, and at least one solid state light emitter. The solid state light emitter is mounted on the fixture. The lighting device provides, after 50,000 hours of illumination, light of an intensity which is at least 50 percent of its initial intensity.

The invention may be more fully understood with reference to the accompanying drawings and the following detailed description of the invention.

BRIEF DESCRIPTION OF THE DRAWING FIGURES

DETAILED DESCRIPTION OF THE INVENTION

Figure 1:
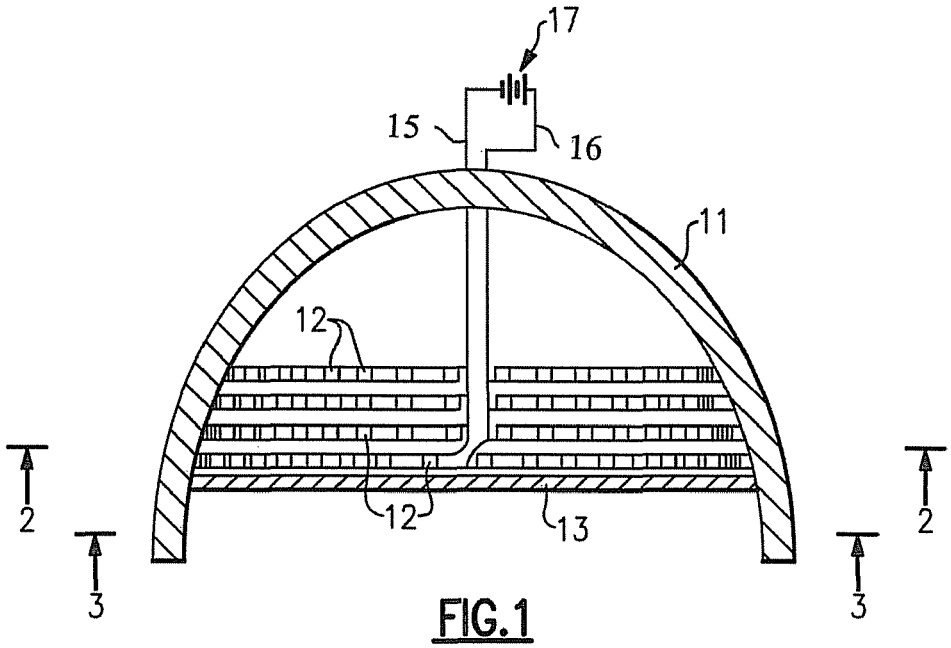
FIG. 1 is a sectional view of a first embodiment of a lighting device according to the present invention.

As described above, in one aspect, the present invention is directed to a lighting device which comprises a housing, at least one solid state light emitter, and conductive tracks for supplying electricity to the solid state light emitter(s). The present invention is also directed to a lighting device which comprises a housing, at least one solid state light emitter, at least one luminescent material and conductive tracks for supplying electricity to the solid state light emitter(s).

The conductive tracks can be positioned in any suitable way. For example, the conductive tracks can, if desired, be positioned on at least a first portion of the housing, and comprise at least a first positive conductive track and at least a first negative conductive track.

Each solid state light emitter can be mounted in any suitable arrangement. For example, the solid state light emitter(s) can, if desired, be mounted on the housing, in electrical contact with at least one negative conductive track and at least one positive conductive track.

Preferably, one or more surfaces of the housing is/are reflective, so that light from some or all of the light emitting diodes is reflected by such reflective surfaces.

The housing can be formed of any material which can be molded and/or shaped. Preferably, the housing is formed of a material which is an effective heat sink (i.e., which has high thermal conductivity and/or high heat capacity) and/or which is reflective (or which is coated with a reflective material).

The housing can be any desired shape. Representative examples of shapes for the housing include hollow conical (or substantially conical), hollow frustoconical (or substantially frustoconical), hollow cylindrical (or substantially cylindrical) and hollow semi-elliptical (or substantially semi-elliptical), or any shape which includes one or more portions which are individually selected film among hollow conical (or substantially conical), hollow frustoconical (or substantially frustoconical), hollow cylindrical (or substantially cylindrical) and hollow semi-elliptical (or substantially semi-elliptical). In one aspect of the invention, the housing comprises at least a first concave surface, at least one of the solid state light emitters being mounted on the first concave surface. Optionally, the housing can comprise numerous concave surfaces, and one or more light emitting diodes can be mounted on any or all of such concave surfaces.

As used herein, the term "substantially," e.g., in the expressions "substantially conical", "substantially frustoconical", "substantially cylindrical" and "substantially semi-elliptical", means at least about 95% correspondence with the feature recited, e.g., "substantially semi-elliptical" means that a semi-ellipse can be drawn having the formula $x^2/a^2+y^2/b^2=1$, where $y \geqq 0$, and imaginary axes can be drawn at a location where the y coordinate of each point on the structure is within 0.95 to 1.05 times the value obtained by inserting the x coordinate of such point into such formula, etc.

Any desired solid state light emitter or emitters can be employed in accordance with the present invention. Persons of skill in the art are aware of, and have ready access to, a wide variety of such emitters. Such solid state light emitters include inorganic and organic light emitters. Examples of types of such light emitters include light emitting diodes (inorganic or organic), laser diodes and thin film electroluminescent devices, a variety of each of which are well-known in the art.

In one aspect of the present invention, there is provided a device which comprises at least first and second solid state light emitters, in which the first solid state light emitter emits light of a first wavelength and the second solid state light emitter emits light of a second wavelength, the second wavelength differing from the first wavelength. In such a device, the solid state light emitters can emit light of any desired wavelength or wavelengths (or wavelength range or wavelength ranges) within the ranges of infrared, visible and ultraviolet light, including, e.g., (1) two or more light emitting diodes emitting light within different wavelength ranges within the visible spectrum, (2) two or more light emitting diodes emitting light within different wavelength ranges within the infrared spectrum, (3) two or more light emitting diodes emitting light within different wavelength ranges within the ultraviolet spectrum, (4) one or more light emitting diodes emitting light within the visible spectrum and one or more light emitting diodes emitting light within the infrared spectrum, (5) one or more light emitting diodes emitting light within the visible spectrum and one or more light emitting diodes emitting light within the ultraviolet spectrum, etc.

As noted above, persons skilled in the art are familiar with a wide variety of solid state light emitters, including a wide variety of light emitting diodes, a wide variety of laser diodes and a wide variety of thin film electroluminescent devices, and therefore it is not necessary to describe in detail such devices, and/or the materials out of which such devices are made.

As indicated above, the lighting devices according to the present invention can comprise any desired number of solid state emitters. For example, a lighting device according to the present invention can include 50 or more light emitting diodes, or can include 100 or more light emitting diodes, etc. In general, with current light emitting diodes, excellent efficiency can be achieved by using a large number of comparatively small light emitting diodes (e.g., 100 light emitting diodes each having a surface area of 0.1 $mm^2$ vs. 25 light emitting diodes each having a surface area of 0.4 $mm^2$ but otherwise being identical).

Analogously, light emitting diodes which operate at lower current densities provide excellent efficiency. Light emitting diodes which draw any particular current can be used according to the present invention. In some embodiments of the present invention, light emitting diodes which each draw not more than 50 milliamps are employed.

On the other hand, current "power chips" can provide excellent performance as well. Accordingly, some embodiments of the present invention are lighting devices which include 30 light emitting diodes or fewer (and in some cases, 20 light emitting diodes or fewer), the light emitting diodes each operating at 300 mA or more.

Persons of skill in the art are familiar with various ways of attaching solid state light emitters to housings, and any such ways can be employed in accordance with the present invention.

The conductive tracks can be any structure which conducts electricity. Persons of skill in the art are familiar with, and can readily provide, a wide variety of conductive tracks provided in a wide variety of forms. For example, conductive tracks can be metallized traces formed on, painted on or printed on the housing, or can be wires or lead frames placed along a surface or surfaces of the housing.

Figure 13:
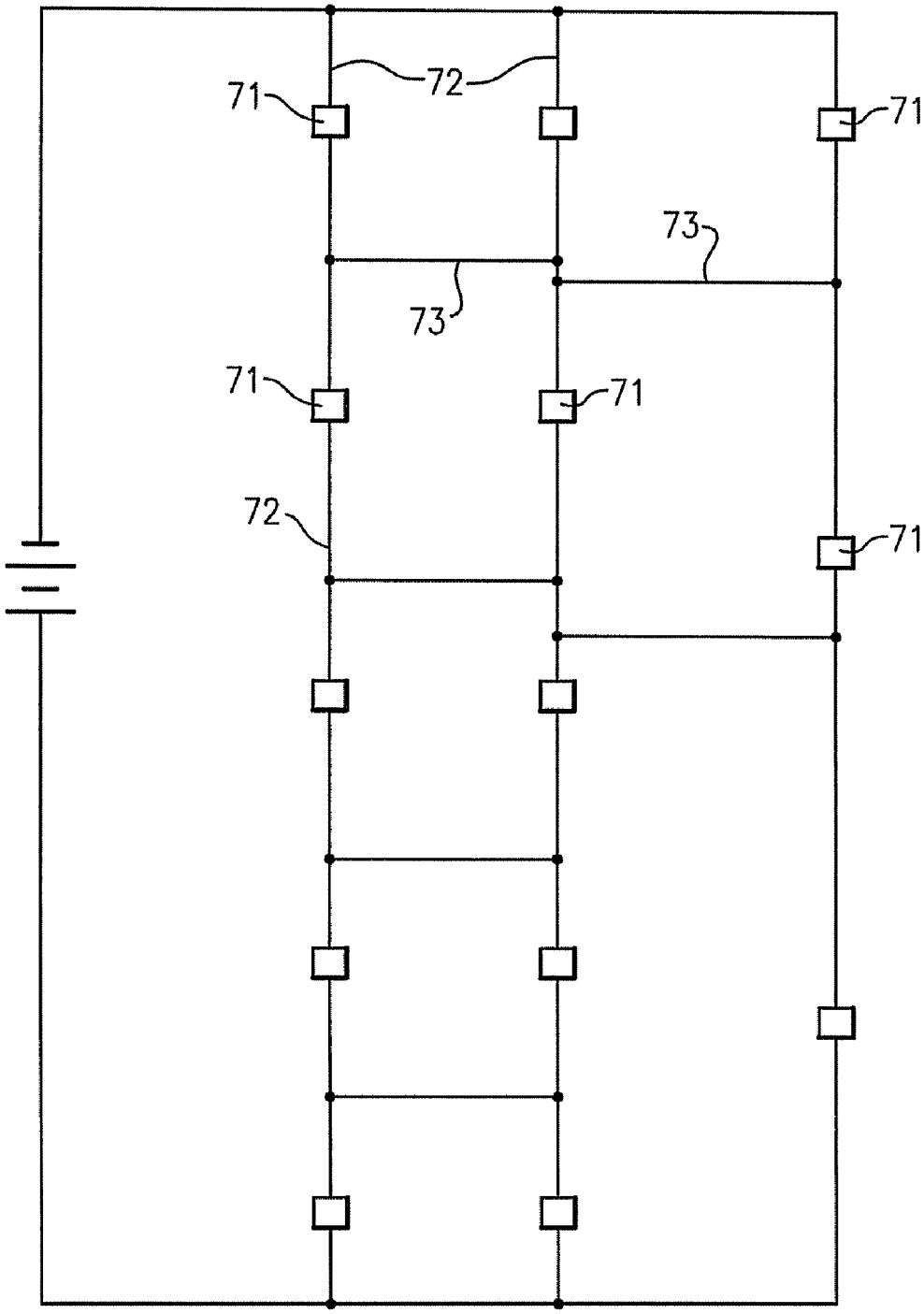
FIG. 13 is a schematic electrical diagram showing a plurality of solid state light emitters wired in a mesh pattern.

The solid state light emitters can be wired in any suitable pattern. Preferably, the plurality of solid state light emitters are wired in a mesh pattern (see FIG. 13, which is a schematic diagram showing a plurality of solid state light emitters 71 arranged in strings with conductive elements 72 connecting the solid state light emitters in a particular string, and with one or more cross-connection conductive elements 73 extending between the strings). Another example of a wiring pattern which can be used is series parallel, such that failure of one of the solid state light emitters would affect only solid state light emitters in series with the solid state light emitter that failed. The expression "series parallel", as used herein, means electrical paths are arranged in parallel, each electrical path including one or more solid state light emitters.

In one aspect of the invention, the conductive tracks (and therefor the solid state light emitters as well) are coupleable, i.e., can be electrically connected (permanently or selectively), to one or more power supply, e.g., to one or more batteries and/or to electrical service. For example, circuitry can be provided in which (1) electricity is normally supplied to the lighting device through electrical service (e.g., connected to the grid) under normal conditions, and in which (2) if electrical service is interrupted (e.g., in the case of a power outage), one or more switches can be closed whereby power can be supplied to some (e.g., at least about 5 percent or at least about 20 percent) or all of the solid state light emitters. Where necessary, there is preferably further provided a device which detects when electrical service has been interrupted, and automatically switches on battery power to at least some of the solid state light emitters.

A statement herein that two components in a device are "electrically connected," means that there are no components electrically between the components, the insertion of which materially affect the function or functions provided by the device. For example, two components can be referred to as being electrically connected, even though they may have a small resistor between them which does not materially affect the function or functions provided by the device (indeed, a wire connecting two components can be thought of as a small resistor); likewise, two components can be referred to as being electrically connected, even though they may have an additional electrical component between them which allows the device to perform an additional function, while not materially affecting the function or functions provided by a device which is identical except for not including the additional component; similarly, two components which are directly connected to each other, or which are directly connected to opposite ends of a wire or a trace on a circuit board or another medium, are electrically connected.

In another aspect of the invention, the solid state light emitters can optionally be connected (permanently or selectively) to one or more photovoltaic energy collection device (i.e., a device which includes one or more photovoltaic cells which converts energy film the sun into electrical energy), such that energy can be supplied from the photovoltaic energy collection device to the solid state light emitters.

Persons of skill in the art are familiar with various ways of electrically connecting (permanently or selectively) conductive tracks to power supplies, and any such ways can be employed in accordance with the present invention.

The one or more luminescent materials, if present, can be any desired luminescent material. As noted above, persons skilled in the art are familiar with, and have ready access to, a wide variety of luminescent materials. The one or more luminescent materials can be down-converting or up-converting, or can include a combination of both types.

For example, the one or more luminescent materials can be selected from among phosphors, scintillators, day glow tapes, inks which glow in the visible spectrum upon illumination with ultraviolet light, etc.

The one or more luminescent materials, when provided, can be provided in any desired form. For example, in one aspect, a lighting device according to the present invention can comprise at least one luminescent element which comprises a first luminescent material, the luminescent element being attached to the housing, the luminescent element and the housing defining an internal space, at least one of the solid state light emitters being positioned within the internal space.

The luminescent element can, if desired, comprise a material in which the first luminescent material is embedded. For example, persons of skill in the art are very familiar with luminescent elements comprising a luminescent material, e.g., a phosphor, embedded in a resin (i.e., a polymeric matrix), such as a silicone material or an epoxy material.

In a preferred aspect of the present invention, the lighting device comprises at least one luminescent element which comprises at least a first luminescent element region and a second luminescent element region, the first luminescent element region comprising a first luminescent material, the second luminescent element region comprising a second luminescent material, the first luminescent material, upon being excited, emitting light of a first wavelength (or range of wavelengths), the second luminescent material, upon being excited, emitting light of a second wavelength (or range of wavelengths), the second wavelength (or range of wavelengths) differing from the first wavelength (or range of wavelengths).

In accordance with another preferred aspect of the invention, a lighting device can comprise a plurality of luminescent elements, each luminescent element comprising at least one luminescent material, each luminescent element being attached to the housing to define an internal space, at least one solid state light emitter being positioned within each internal space.

In embodiments of the present invention in which a plurality of solid state light emitters are mounted on a housing, the heat load produced by the solid state light emitters is distributed over the surface of the housing. The more uniformly the solid state light emitters are distributed over the surface area of the housing, the more uniformly the heat load is distributed. As a result, the housing can provide more efficient heat dissipation, with the result that the housing can, if desired, be made smaller than would otherwise be the case. In addition, by having multiple solid state light emitters (as opposed to a single point source of light), the light source is affected less by shadowing—that is, if an object which is smaller than the light emitting area is placed in front of the light emitting area, only a portion of the light rays would be blocked. Since the light sources follow the Huygens principle (each source acts as a spherical wave front), the viewing of a shadow is not seen, and only a slight dimming of the illuminated source is seen (in contrast to where a single filament is employed, where the light would be substantially dimmed and a shadow would be observed).

Persons of skill in the art are familiar with various ways of attaching luminescent elements to housings, and any such ways can be employed in accordance with the present invention.

The devices according to the present invention can further comprise one or more long-life cooling device (e.g., a fan with an extremely high lifetime). Such long-life cooling device(s) can comprise piezoelectric or magnetorestrictive materials (e.g., MR, GMR, and/or HMR materials) that move air as a "Chinese fan". In cooling the devices according to the present invention, typically only enough air to break the boundary layer is required to induce temperature drops of 10 to 15 degrees C. Hence, in such cases, strong 'breezes' or a large fluid flow rate (large CFM) are typically not required (thereby avoiding the need for conventional fans).

The devices according to the present invention can further comprise secondary optics to further change the projected nature of the emitted light. Such secondary optics are well-known to those skilled in the art, and so they do not need to be described in detail herein—any such secondary optics can, if desired, be employed.

The devices according to the present invention can further comprise sensors or charging devices or cameras, etc. For example, persons of skill in the art are familiar with, and have ready access to, devices which detect one or more occurrence (e.g., motion detectors, which detect motion of an object or person), and which, in response to such detection, trigger illumination of a light, activation of a security camera, etc. As a representative example, a device according to the present invention can include a lighting device according to the present invention and a motion sensor, and can be constructed such that (1) while the light is illuminated, if the motion sensor detects movement, a security camera is activated to record visual data at or around the location of the detected motion, or (2) if the motion sensor detects movement, the light is illuminated to light the region near the location of the detected motion and the security camera is activated to record visual data at or around the location of the detected motion, etc.

FIG. 1 is a sectional view of a first embodiment of a lighting device 10 according to the present invention. Referring to FIG. 1, the first embodiment comprises a housing 11, a plurality of light emitting diodes 12 mounted on the housing 11, and a substantially circular luminescent element 13 attached to the housing 11. The housing 11 and the luminescent element 13 together define an internal space within which each of the light emitting diodes 12 are positioned. The housing 11 has a hollow substantially semi-elliptical shape. The surface of the housing 11 which faces the internal space has a reflective surface coated thereon, as well as conductive tracks 14 printed thereon. The luminescent element 13 comprises a cured polymeric resin with a phosphor powder loaded therein. The lighting device 10 further comprises a power cord including a negative power line 15 electrically connected to negative power tracks and a positive power line 16 electrically connected to positive power tracks, the power cord being connectable to a power supply, such that the conductive tracks are coupleable with a power supply. Each of the light emitting diodes 12 is in electrical contact with at least one positive conductive track and at least one negative conductive track, whereby power can be provided to the light emitting diodes 12 to illuminate them. FIG. 1 schematically illustrates a power supply 17 attached to the negative and positive power lines 15 and 16.

Figure 2:
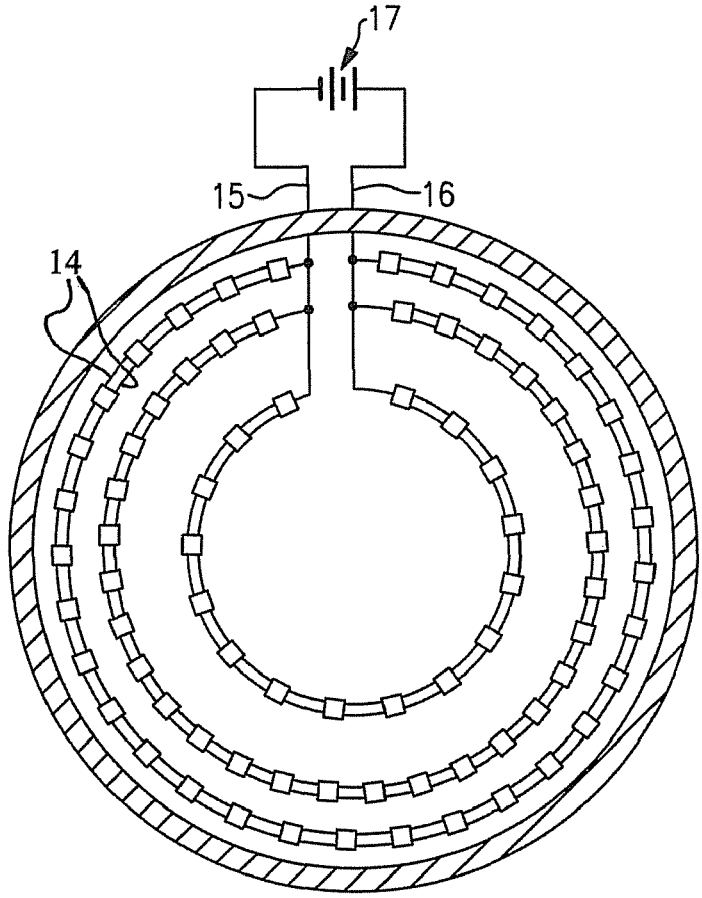
FIG. 2 is a partially schematic sectional view of the embodiment shown in FIG. 1, taken along line 2-2 in FIG. 1.

FIG. 2 is a sectional view of the embodiment shown in FIG. 1, taken along line 2-2 in FIG. 1.

Figure 3:
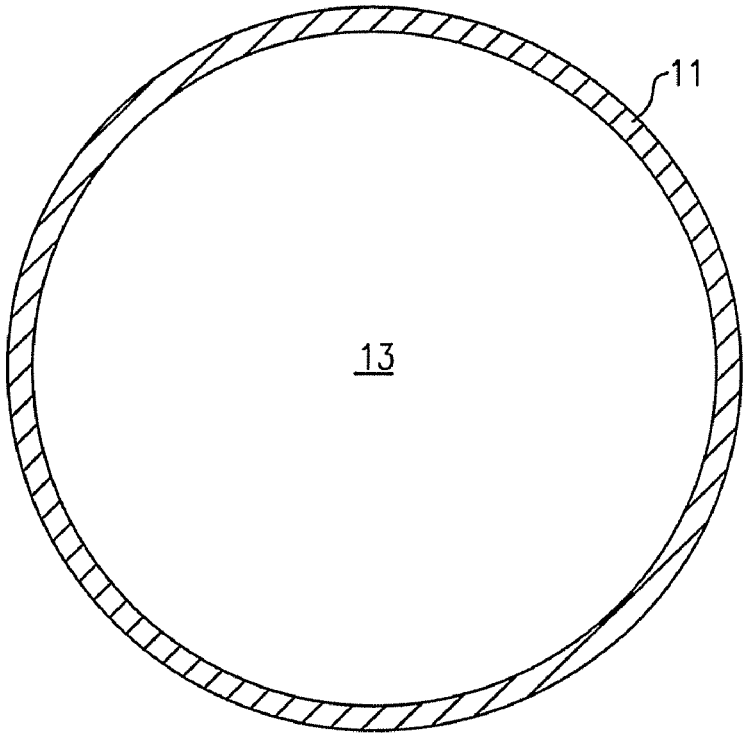
FIG. 3 is a sectional view of the embodiment shown in FIG. 1, taken along line 3-3 in FIG. 1.

FIG. 3 is a sectional view of the embodiment shown in FIG. 1, taken along line 3-3 in FIG. 1. FIG. 3 shows the luminescent element 13, in this case containing a single luminescent material.

Figure 4:
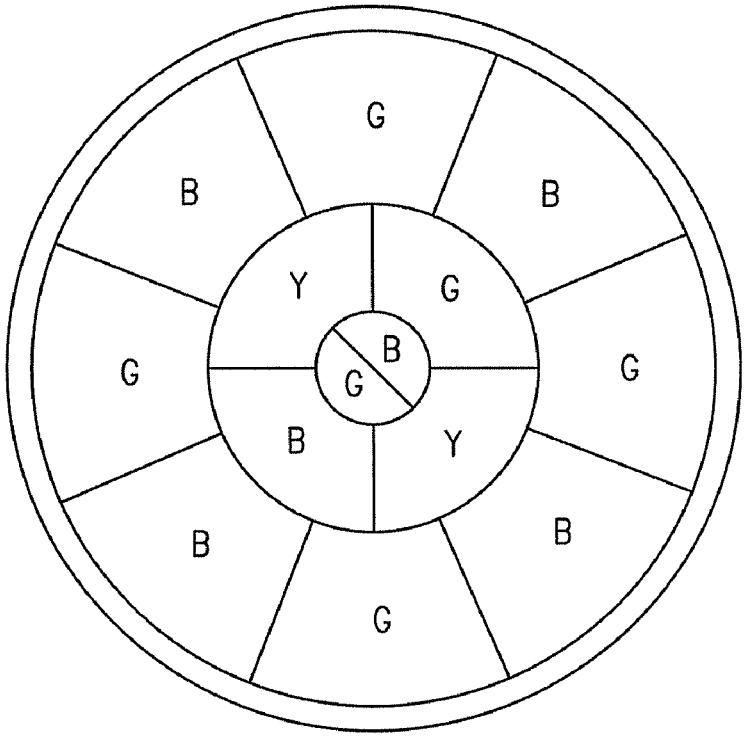
FIG. 4 is a sectional view corresponding to the view depicted in FIG. 3, with a modification.

FIG. 4 is a sectional view corresponding to the view depicted in FIG. 3, modified in that instead of the luminescent element 13 containing a single luminescent material, the luminescent element 13 has a plurality of regions, each of the regions having a luminescent material selected from among luminescent material which, when illuminated by the light emitting diodes 12, emit blue light, green light or yellow light. The regions depicted in FIG. 4 are marked to indicate the type of luminescent material in each region, where a "B" marked in the region indicates that the region contains luminescent material which, when illuminated by the light emitting diodes 12, will emit blue light, where a "G" marked in the region indicates that the region contains luminescent material which, when illuminated by the light emitting diodes 12, will emit green light, and where a "Y" marked in the region indicates that the region contains luminescent material which, when illuminated by the light emitting diodes 12, will emit yellow light.

Figure 5:
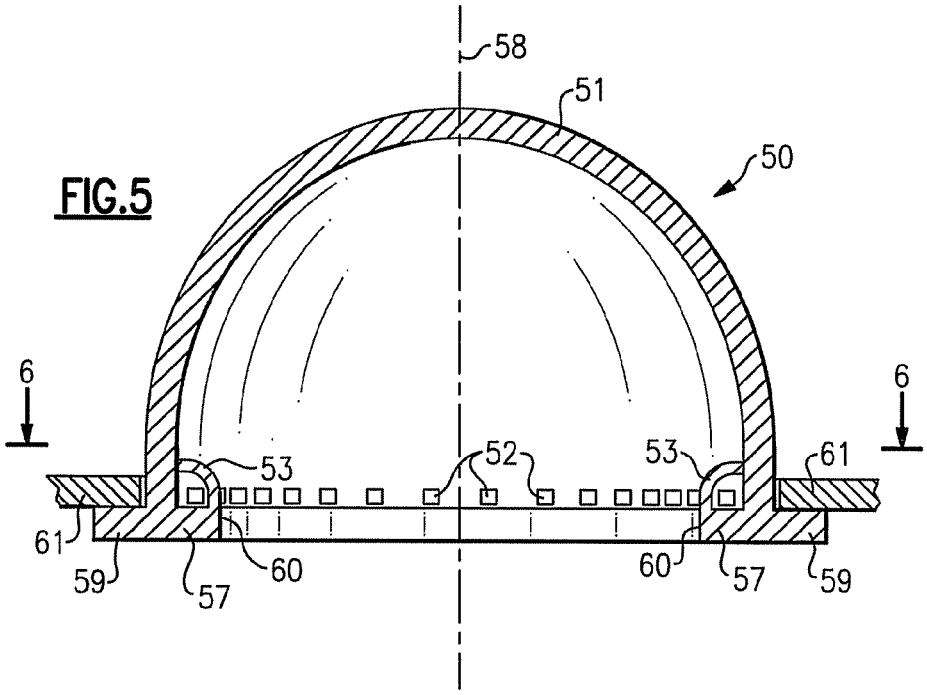
FIG. 5 is a sectional view of a second embodiment of a lighting device according to the present invention.

FIG. 5 is a sectional view of a second embodiment of a lighting device 50 according to the present invention. Referring to FIG. 5, the second embodiment comprises a housing 51 having a first annular flange portion 57 extending radially inwardly toward the center axis 58 of the housing 51 and a second annular flange portion 59 extending radially outwardly from the center axis 58 of the housing 51. A plurality of light emitting diodes 52 are mounted on the first annular flange portion 57. A luminescent element 53 is attached to the housing 51 and to an inner edge 60 of the first annular flange portion 57. The housing 51, the first annular flange portion 57 and the luminescent element 53 together define a toroidal internal space within which each of the light emitting diodes 52 are positioned. The housing 51 has a hollow substantially semi-elliptical shape. The surface of the housing 51 which faces the internal space has a reflective surface coated thereon. If desired, any suitable cover, a variety of which are well-known to those skilled in the art, can be positioned over the opening defined by the inner edge 60 of the first annular flange portion 57.

Figure 6:
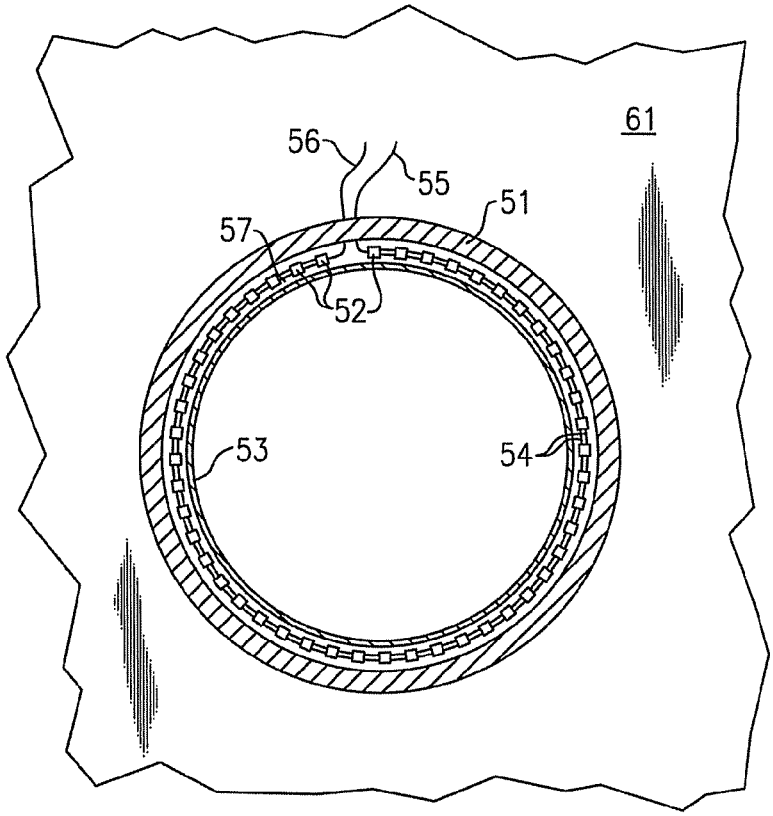
FIG. 6 is a sectional view of the embodiment shown in FIG. 5, taken along line 6-6 in FIG. 5.

FIG. 6 is a sectional view of the embodiment shown in FIG. 5, taken along line 6-6 in FIG. 5. FIG. 6 shows the first annular flange portion 57 with light emitting diodes 52 mounted thereon. FIG. 6 also shows conductive tracks 54 printed on the first annular flange portion 57 to provide electrical power to the light emitting diodes 52.

Referring again to FIG. 5, the lighting device 50 is mounted in a circular hole formed in a ceiling 61 (e.g., formed of wallboard or any other suitable construction material), i.e., the second annular flange portion 59 is in contact with the ceiling 61. The luminescent element 53 comprises a cured polymeric resin with a phosphor powder loaded therein. Referring to FIG. 6, the lighting device 50 further comprises a power cord including a negative power line 55 electrically connected to the negative power track and a positive power line 56 electrically connected to the positive power track, the power cord being connectable to a power supply, such that the conductive tracks are coupleable with a power supply. Each of the light emitting diodes 52 is in electrical contact with the positive conductive track and the negative conductive track, whereby power can be provided to the light emitting diodes 52 to illuminate them.

Figure 7:
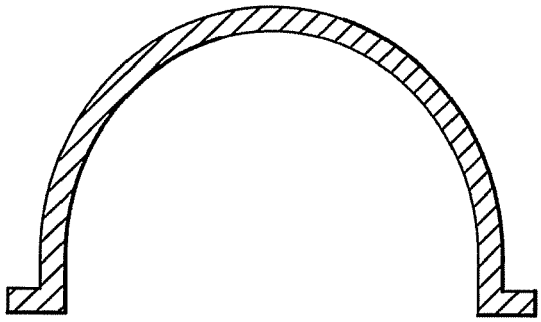
FIGS. 7-12 depict sectional views of a variety of housings of different shapes.
Figure 8:
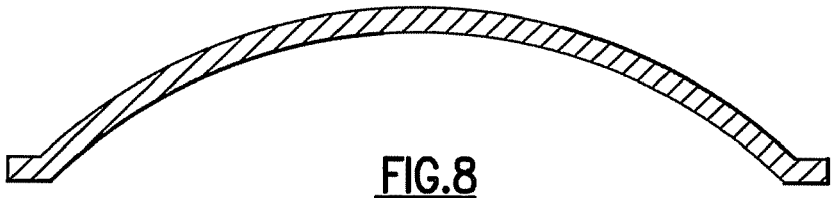
Figure 9:
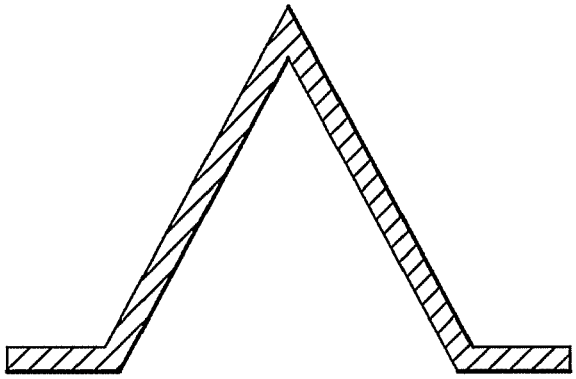
Figure 10:
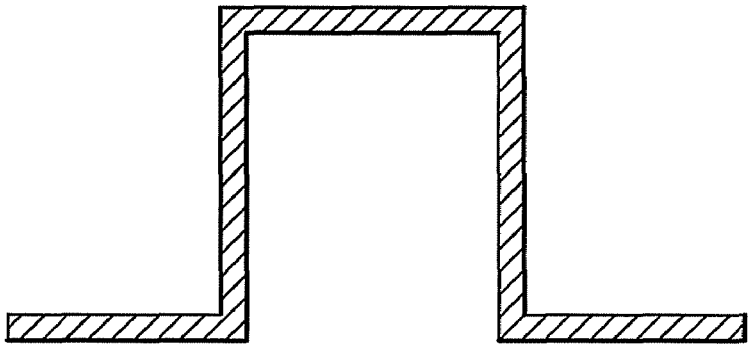
Figure 11:
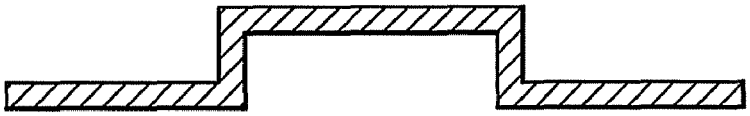
Figure 12:
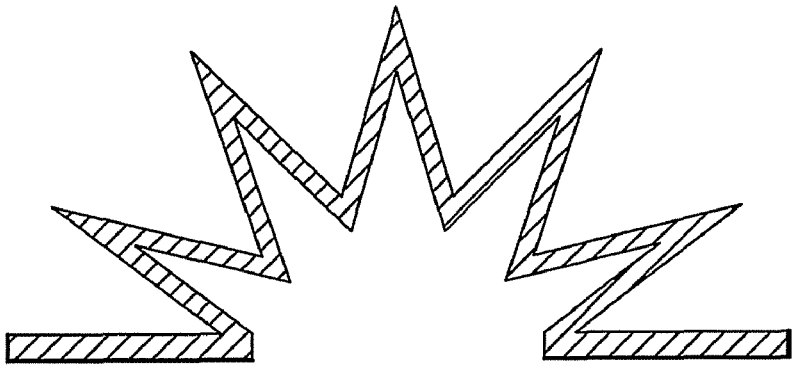

As noted above, the housing can generally be of any desired size and shape. FIGS. 7-12 depict sectional views of a variety of housings of different shapes. FIG. 7 is a sectional view of a first hollow semi-elliptical housing. FIG. 8 is a sectional view of a second hollow semi-elliptical housing. FIG. 9 is a sectional view of a hollow conical housing. FIG. 10 is a sectional view of a first hollow cylindrical housing. FIG. 11 is a sectional view of a second hollow cylindrical housing. FIG. 12 is a sectional view of a housing having a plurality of hollow conical portions.

Any two or more structural parts of the lighting devices described herein can be integrated. Any structural part of the lighting devices described herein can be provided in two or more parts (which can be held together, if necessary).

The invention claimed is:

1. A lighting device comprising:

a housing;

at least a first solid state light emitter; and conductive tracks coupleable with at least one power supply, said conductive tracks on at least a first portion of at least one surface of said housing, said conductive tracks comprising at least a first positive conductive track and at least a first negative conductive track, said first solid state light emitter mounted on said housing, said first solid state light emitter in direct contact with at least said first positive conductive track, said first solid state light emitter in direct contact with at least said first negative conductive track said at least one surface of said housing defining a space, at least said first solid state light emitter in said space.

2. A lighting device as recited in claim 1, wherein said lighting device comprises a plurality of solid state light emitters, each of said solid state light emitters in contact with at least one positive conductive track and at least one negative conductive track.

3. A lighting device as recited in claim 2, wherein each of said solid state light emitters is a light emitting diode.

4. A lighting device as recited in claim 2, wherein said plurality of solid state light emitters are wired in a mesh pattern comprising at least one cross-connection.

5. A lighting device as recited in claim 2, wherein said plurality of solid state light emitters are wired in series parallel.

6. A lighting device as recited in claim 2, further comprising at least one battery and circuitry selectively connecting said battery electrically to at least some of said solid state light emitters.

7. A lighting device as recited in claim 6, wherein said circuitry selectively connects said battery electrically to at least about 5% of said solid state light emitters.

8. A lighting device as recited in claim 6, wherein said circuitry selectively connects said battery electrically to all of said solid state light emitters.

9. A lighting device as recited in claim 6, wherein said circuitry automatically connects said battery electrically to at least some of said solid state light emitters during a power outage.

10. A lighting device as recited in claim 2, wherein said housing comprises a plurality of concave surfaces, each said concave surface having at least a portion thereof which is reflective, each said concave surface having mounted thereon at least one of said solid state light emitters.

11. A lighting device as recited in claim 1, wherein said solid state light emitter is a light emitting diode.

12. A lighting device as recited in claim 1, wherein said housing comprises at least a first concave surface, at least a portion of said first concave surface is reflective, and said first solid state light emitter is mounted on said first concave surface.

13. A lighting device as recited in claim 12, wherein said first concave surface is substantially hollow conical.

14. A lighting device as recited in claim 12, wherein said first concave surface is substantially hollow semi-elliptical.

15. A lighting device as recited in claim 12, wherein said first concave surface is substantially hollow cylindrical.

16. A lighting device as recited in claim 1, wherein said lighting device comprises at least a first light emitting diode which emits light within a first wavelength range and at least a second light emitting diode which emits light within a second wavelength range, and all values within said second wavelength range are different from all values within said first wavelength range.

17. A lighting device as recited in claim 16, wherein said first wavelength range is within said range of visible light wavelengths and said second wavelength range is within said range of ultraviolet light wavelengths.

18. A lighting device as recited in claim 1, wherein said lighting device comprises at least 50 light emitting diodes.

19. A lighting device as recited in claim 18, wherein each of said light emitting diodes draws not more than 50 milliamps of current.

20. A lighting device as recited in claim 1, wherein said lighting device comprises not more than 30 light emitting diodes.

21. A lighting device as recited in claim 20, wherein each of said light emitting diodes draws at least 300 milliamps of current.

22. A lighting device as recited in claim 20, wherein each of said light emitting diodes draws not more than 50 milliamps of current.

23. A lighting device as recited in claim 1, wherein said lighting device comprises not more than 20 light emitting diodes.

24. A lighting device as recited in claim 23, wherein each of said light emitting diodes draws at least 300 milliamps of current.

25. A lighting device as recited in claim 1, wherein said lighting device comprises at least 100 light emitting diodes.

26. A lighting device as recited in claim 1, further comprising at least one battery and circuitry connecting said battery to said conductive tracks.

27. A lighting device as recited in claim 26, wherein said circuitry connecting said battery to said conductive tracks selectively electrically connects said battery to said conductive tracks.

28. A lighting device as recited in claim 26, wherein said circuitry connecting said battery to said conductive tracks electrically connects said battery to said conductive tracks.

29. A lighting device as recited in claim 26, wherein said battery is electrically connected to at least one photovoltaic energy collection device.

30. A lighting device as recited in claim 1, further comprising at least one photovoltaic energy collection device and circuitry connecting said photovoltaic energy collection device to said conductive tracks.

31. A lighting device as recited in claim 30, wherein said circuitry connecting said photovoltaic energy collection device to said conductive tracks selectively electrically connects said photovoltaic energy collection device to said conductive tracks.

32. A lighting device as recited in claim 30, wherein said circuitry connecting said photovoltaic energy collection device to said conductive tracks electrically connects said photovoltaic energy collection device to said conductive tracks.

33. A lighting device as recited in claim 1, further comprising at least a first luminescent material.

34. A lighting device as recited in claim 33, wherein said first luminescent material comprises at least a first phosphor.

35. A lighting device as recited in claim 33, wherein said lighting device comprises at least one luminescent element which comprises said first luminescent material, said luminescent element is attached to said housing, said luminescent element and said housing define an internal space, and said solid state light emitter is within said internal space.

36. A lighting device as recited in claim 35, wherein said luminescent element has said first luminescent material embedded therein.

37. A lighting device as recited in claim 33, wherein said lighting device comprises at least one luminescent element which comprises at least a first luminescent element region and a second luminescent element region, said first luminescent element region comprising said first luminescent material, said second luminescent element region comprising said second luminescent material, said first luminescent material, upon being excited, emitting light within a first wavelength range, said second luminescent material, upon being excited, emitting light within a second wavelength range, all values within said second wavelength range being different from all values within said first wavelength range.

38. A lighting device as recited in claim 33, wherein said lighting device comprises a plurality of luminescent elements, each luminescent element comprises at least one luminescent material, each luminescent element is attached to said housing to define an internal space, and at least one solid state light emitter is within each internal space.

39. A lighting device as recited in claim 1, wherein said conductive tracks are metallized portions of said housing.

40. A lighting device as recited in claim 39, wherein said conductive tracks have been painted on said housing.

41. A lighting device as recited in claim 39, wherein said conductive tracks have been printed on said housing.

42. A lighting device as recited in claim 1, wherein said lighting device provides light of an initial intensity when initially illuminated, and provides light of an intensity which is at least 50 percent of said initial intensity after 50,000 hours of illumination.

43. A lighting device as recited in claim 1, wherein said device comprises a plurality of solid state light emitters mounted on an annular flange portion of said housing.

44. A lighting device as recited in claim 43, further comprising a luminescent element attached to said housing and to an inner edge of said annular flange portion, said luminescent element, said housing and said annular flange portion defining an internal space, said solid state light emitters in said internal space.

45. A lighting device as recited in claim 1, wherein said conductive tracks each comprise a conductive portion and an insulating layer.

46. A lighting device as recited in claim 1, wherein said first positive conductive track and said first negative conductive track are in direct contact with said housing.

47. A lighting device consisting essentially of:

a housing;

at least one solid state light emitter; and conductive tracks coupleable with at least one power supply, said conductive tracks on at least a first portion of at least one surface of said housing, said conductive tracks comprising at least a first positive conductive track and at least a first negative conductive track, said solid state light emitter in electrical contact with at least one said positive conductive track, said solid state light emitter in electrical contact with at least one said negative conductive track, said at least one surface of said housing defining a space, at least one of said at least one solid state light emitter in said space.

48. A lighting device comprising:

a housing;

at least a first solid state light emitter; and conductive tracks coupleable with at least one power supply, said conductive tracks on at least a first portion of at least one surface of said housing, said conductive tracks comprising at least a first positive conductive track and at least a first negative conductive track, at least a portion of at least one of said first positive conductive track and said first negative conductive track in direct contact with said housing, said first solid state light emitter in direct contact with at least said first positive conductive track, said first solid state light emitter in direct contact with at least said first negative conductive track said at least one surface of said housing defining a space, at least said first solid state light emitter in said space.

49. A lighting device comprising:

a housing;

at least a first solid state light emitter; and conductive tracks coupleable with at least one power supply, said conductive tracks on at least a first portion of said housing, said conductive tracks comprising at least a first positive conductive track and at least a first negative conductive track, said first solid state light emitter mounted on a surface of said housing, said surface of said housing tangential to at least two planes, said at least two planes being nonparallel, said first solid state light emitter in direct contact with at least said first positive conductive track, said first solid state light emitter in direct contact with at least said first negative conductive track.

* * * * *